US008284132B2

(12) United States Patent
Chung

(10) Patent No.: US 8,284,132 B2
(45) Date of Patent: Oct. 9, 2012

(54) ORGANIC LIGHT EMITTING DISPLAY DEVICE AND METHOD OF DRIVING THE SAME

(75) Inventor: Bo-Yong Chung, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 770 days.

(21) Appl. No.: 12/489,280

(22) Filed: Jun. 22, 2009

(65) Prior Publication Data

US 2010/0013868 A1 Jan. 21, 2010

(30) Foreign Application Priority Data

Jul. 17, 2008 (KR) ..... 10-2008-0069529

(51) Int. Cl.
*G09G 3/30* (2006.01)
*G09G 3/10* (2006.01)

(52) U.S. Cl. ..... 345/77; 345/76; 315/169.3

(58) Field of Classification Search ..... 345/76–84, 345/204–215, 690–699; 315/169.1–169.4
See application file for complete search history.

(56) References Cited

U.S. PATENT DOCUMENTS

2005/0243037 A1* 11/2005 Eom et al. ..... 345/76
2007/0024540 A1* 2/2007 Ryu et al. ..... 345/76
2007/0024541 A1* 2/2007 Ryu et al. ..... 345/76
2007/0035487 A1* 2/2007 Ryu et al. ..... 345/76
2007/0085781 A1* 4/2007 Chung et al. ..... 345/76
2008/0211747 A1* 9/2008 Kim ..... 345/76
2009/0027423 A1* 1/2009 Kwon ..... 345/690
2009/0051628 A1* 2/2009 Kwon ..... 345/77

FOREIGN PATENT DOCUMENTS

KR 10-2005-0085309 8/2005
KR 10-2007-0015822 A 2/2007
KR 10-2007-0019396 A 2/2007
KR 10-2007-0057574 6/2007
KR 10-2008-0079554 A 9/2008
KR 10-2009-0042405 A 4/2009

OTHER PUBLICATIONS

KIPO Office action dated Jun. 14, 2010 issued to priority Korean patent application No. 10-2008-0069529, listing the cited references in this IDS.

* cited by examiner

*Primary Examiner* — Alexander Eisen
*Assistant Examiner* — Patrick F Marinelli
(74) *Attorney, Agent, or Firm* — Christie, Parker & Hale, LLP

(57) ABSTRACT

An organic light emitting display device and a method of driving the same. In a method of driving an organic light emitting display device including a second capacitor having a first terminal coupled to a gate electrode of a driving transistor and a first capacitor coupled between the gate electrode of the driving transistor and a first power source, the driving method includes supplying a threshold voltage of an organic light emitting diode to a second terminal of the second capacitor during a period when a first current is sunk via the driving transistor, and supplying a data signal to the second terminal of the second capacitor after a voltage corresponding to a difference between a voltage applied to the gate electrode of the driving transistor and the threshold voltage of the organic light emitting diode is charged in the second capacitor.

8 Claims, 6 Drawing Sheets

ORGANIC LIGHT EMITTING DISPLAY DEVICE AND METHOD OF DRIVING THE SAME

CROSS-REFERENCE TO RELATED APPLICATIONS

This application claims priority to and the benefit of Korean Patent Application No. 10-2008-0069529, filed on Jul. 17, 2008, in the Korean Intellectual Property Office, the entire content of which is incorporated herein by reference.

BACKGROUND OF THE INVENTION

1. Field of the Invention

The present invention relates to an organic light emitting display device and a method of driving the same.

2. Description of Related Art

Various types of flat panel display devices have reduced weight and volume than those of cathode ray tube display devices. The flat panel display devices include liquid crystal display devices, field emission display devices, plasma display devices, organic light emitting display devices, and the like.

Among these flat panel display devices, the organic light emitting display device displays images by using organic light emitting diodes that emit light through recombination of electrons and holes. The organic light emitting display device has a fast response time and is driven with low power consumption.

An organic light emitting display device displays an image by using pixels arranged in a matrix form. Here, each of the pixels includes an organic light emitting diode and a driving transistor that controls an amount of current supplied to the organic light emitting diode.

An operation of the organic light emitting display device will be described. A voltage corresponding to a data signal is first charged into a storage capacitor coupled to a driving transistor. The driving transistor controls an amount of current supplied to an organic light emitting diode, corresponding to the voltage charged into the storage capacitor. Then, the organic light emitting diode emits light of red, green or blue having a luminance corresponding to the amount of current supplied from the driving transistor.

However, in a conventional organic light emitting display device, the threshold voltages and mobilities of driving transistors for pixels may be unequal due to process deviation. If the threshold voltages and mobilities of the driving transistors for the pixels are unequal, the pixels generate lights having different luminances, corresponding to the same data signal. Accordingly, an image having a desired luminance may not be displayed by the pixels.

In order to solve such a problem, a circuit that compensates for the threshold voltage of a driving transistor may be added to each pixel. However, the circuit added to each of the pixels does not compensate for the mobility of the driving transistor.

As time elapses, an organic light emitting diode is degraded, and therefore, an image having a desired luminance may not be displayed. Practically, as the organic light emitting diode is degraded, the luminance of light generated by the organic light emitting diode gradually becomes lower corresponding to the same data signal.

SUMMARY OF THE INVENTION

Accordingly, it is an aspect of the present invention to provide an organic light emitting display device capable of compensating for the threshold voltage and mobility of a driving transistor and deterioration of an organic light emitting diode, and a method of driving the same.

According to an embodiment of the present invention, a method is provided for driving an organic light emitting display device including a pixel having a pixel circuit for driving an organic light emitting diode included in the pixel, the pixel circuit including a second capacitor having a first terminal coupled to a gate electrode of a driving transistor and a first capacitor coupled between the gate electrode of the driving transistor and a first power source. The method includes: sinking a first current via the driving transistor; supplying a threshold voltage of an organic light emitting diode to a second terminal of the second capacitor during a period when the first current is sunk via the driving transistor; supplying a data signal to the second terminal of the second capacitor after a voltage corresponding to a difference between a voltage applied to the gate electrode of the driving transistor and the threshold voltage of the organic light emitting diode is charged in the second capacitor; and charging a voltage corresponding to a difference between the voltage applied to the gate electrode of the driving transistor and a voltage of the first power source in the first capacitor.

According to another embodiment of the present invention, an organic light emitting display device includes: a scan driver for sequentially supplying a scan signal to scan lines and sequentially supplying a light-emitting control signal to light-emitting control lines; a data driver for supplying data signals to the data lines; pixels at crossing regions of the scan lines and the data lines; and a current sinker coupled to feedback lines for sinking a first current from the pixels, wherein each of the pixels on an i-th horizontal line includes: an organic light emitting diode; a fourth transistor for controlling an amount of current that flows into a second power source via the organic light emitting diode from a first power source; a first transistor coupled between a gate electrode of the fourth transistor and the data line, and configured to turn on when a scan signal is supplied to an i-th scan line; a first capacitor coupled between the gate electrode of the fourth transistor and the first power source; a second capacitor coupled between the gate electrode of the fourth transistor and the first transistor; a second transistor coupled between the gate electrode of the fourth transistor and a second electrode of the fourth transistor, and configured to turn on when the scan signal is supplied to an (i−1)-th scan line; a third transistor coupled between the current sinker and the second electrode of the fourth transistor, and configured to turn on when the scan signal is supplied to the (i−1)-th scan line; and a fifth transistor coupled between an anode electrode of the organic light emitting diode and a common terminal of the first transistor and the second capacitor, and configured to turn on when the scan signal is supplied to the (i−1)-th scan line.

According to still another embodiment of the present invention, an organic light emitting display device includes: a scan driver for supplying a first scan signal to a first scan line during a first period of a horizontal period, supplying a second scan signal to a second scan line during a second period of the horizontal period, and supplying a light-emitting control signal to light-emitting control lines during the horizontal period; a data driver for supplying data signals to data lines during the second period; a current sinker coupled to the data lines for sinking a first current; and pixels coupled to the first scan line and the second scan line, the light-emitting control lines and the data lines, wherein each of the pixels on an i-th horizontal line includes: an organic light emitting diode; a fourth transistor for controlling an amount of current that flows into a second power source via the organic light emitting diode from a first power source; a first transistor coupled between a gate electrode of the fourth transistor and a data line of the data lines, and configured to turn on when the second scan signal is supplied to the second scan line; a first capacitor coupled between the gate electrode of the fourth transistor and the first power source; a second capacitor coupled between the gate electrode of the fourth transistor and the first transistor; a second transistor coupled between the gate electrode of the fourth transistor and the data line, and configured to turn on when the first scan signal is supplied to the first scan line; a third transistor coupled between a second electrode of the fourth transistor and the data line, and configured to turn on when the first scan signal is supplied to the first scan line; and a fifth transistor coupled between an anode electrode of the organic light emitting diode and a common terminal of the first transistor and the second capacitor, and configured to turn on when the first scan signal is supplied to the first scan line.

According to an embodiment of the present invention, a pixel of an organic light emitting display device is provided. The pixel includes: an organic light emitting diode; a pixel circuit for supplying a current to the organic light emitting diode; a current sinker coupled to the pixel circuit for sinking a first current from the pixel circuit. The pixel circuit includes: a fourth transistor for controlling an amount of current that flows into a second power source from a first power source via the organic light emitting diode; a first transistor coupled between a gate electrode of the fourth transistor and the data line and configured to turn on when a scan signal is supplied to a scan line; a first capacitor coupled between the gate electrode of the fourth transistor and the first power source; a second capacitor coupled between the gate electrode of the fourth transistor and the first transistor; a second transistor coupled between the gate electrode of the fourth transistor and a second electrode of the fourth transistor, and configured to turn on when the scan signal is supplied to a previous scan line; a third transistor coupled between the current sinker and the second electrode of the fourth transistor, and configured to turn on when the scan signal is supplied to the previous scan line; and a fifth transistor coupled between an anode electrode of the organic light emitting diode and a common terminal of the first transistor and the second capacitor, and configured to turn on when the scan signal is supplied to the previous scan line.

According to an embodiment of the present invention, a pixel of an organic light emitting display device is provided. The pixel includes: an organic light emitting diode; a pixel circuit for supplying a current to the organic light emitting diode, the pixel circuit including: a fourth transistor for controlling an amount of current that flows into a second power source via the organic light emitting diode from a first power source; a first transistor coupled between a gate electrode of the fourth transistor and a data line, and configured to turn on when a second scan signal is supplied to a second scan line coupled to a gate electrode of the first transistor; a first capacitor coupled between the gate electrode of the fourth transistor and the first power source; a second capacitor coupled between the gate electrode of the fourth transistor and the first transistor; a second transistor coupled between the gate electrode of the fourth transistor and the data line, and configured to turn on when a first scan signal is supplied to a first scan line coupled to the gate electrode of the second transistor; a third transistor coupled between a second electrode of the fourth transistor and the data line, and configured to turn on when the first scan signal is supplied to the first scan line; and a fifth transistor coupled between an anode electrode of the organic light emitting diode and a common terminal of the first transistor and the second capacitor, and configured to turn on when the first scan signal is supplied to the first scan line; and a current sinker coupled to the pixel circuit for sinking a first current.

In an organic light emitting display device and a method of driving the same according to the embodiments of the present invention, the threshold voltage and mobility of a driving transistor can be compensated for while sinking a first current by a current sinker. Further, in the embodiments of the present invention, current corresponding to a voltage that rises from the threshold voltage of an organic light emitting diode to the voltage of a data signal is supplied to the organic light emitting diode, thereby compensating for degradation of the organic light emitting diode.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
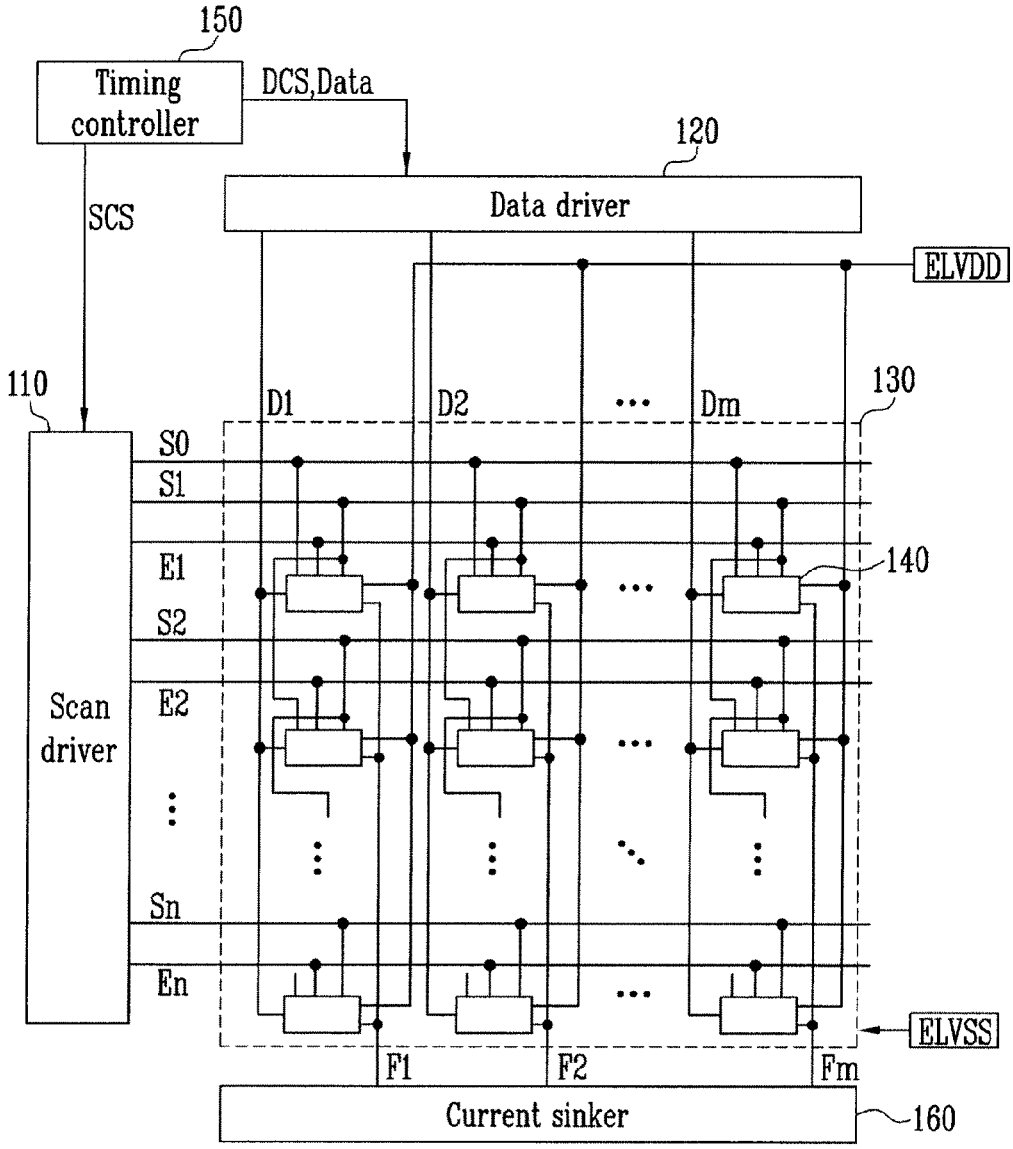
FIG. 1 is a schematic block diagram of an organic light emitting display device according to a first embodiment of the present invention.

Hereinafter, certain exemplary embodiments according to the present invention will be described with reference to the accompanying drawings. Here, when a first element is described as being coupled to a second element, the first element may be directly coupled to the second element or indirectly coupled to the second element via a third element. Further, some of the elements that are not essential to a complete understanding of the present invention are omitted for clarity. Also, like reference numerals refer to like elements throughout.

FIG. 1 is a schematic block diagram of an organic light emitting display device according to a first embodiment of the present invention.

Referring to FIG. 1, the organic light emitting display device according to the first embodiment of the present invention includes a display unit 130 having a plurality of pixels 140 coupled to scan lines S0 to Sn, light-emitting control lines E1 to En and data lines D1 to Dm; a scan driver 110 for driving the scan lines S0 to Sn and the light-emitting control lines E1 to En; a data driver 120 for driving the data lines D1 to Dm; a timing controller 150 for controlling the scan driver 110 and the data driver 120; and a current sinker 160 for sinking a current (e.g., a predetermined current).

The display unit 130 includes the pixels 140 positioned at crossing regions of the scan lines S0 to Sn, the light-emitting control lines E1 to En and the data lines D1 to Dm. The pixels 140 receive first power ELVDD and second power ELVSS supplied from the outside of the display unit 130.

Each of the pixels 140 includes an organic light emitting diode. While receiving the first power ELVDD and the second power ELVSS supplied from the outside, a pixel 140 supplies current corresponding to a data signal to an organic light emitting diode. Therefore, light having a luminance corresponding to the data signal is generated from the organic light emitting diode.

Here, each of the pixels 140 includes a pixel circuit for supplying current to a corresponding organic light emitting diode so as to compensate for the threshold voltage and mobility of a driving transistor and the degradation of the organic light emitting diode. Detailed description will be provided later in conjunction with an exemplary structure of the pixels 140.

The timing controller 150 generates a data driving control signal DCS and a scan driving control signal SCS, corresponding to synchronization signals supplied from the outside of the organic light emitting display device. The data driving control signal DCS generated from the timing controller 150 is supplied to the data driver 120, and the scan driving control signal SCS generated from the timing controller 150 is supplied to the scan driver 110. The timing controller 150 supplies data Data supplied from the outside to the data driver 120.

The scan driver 110 sequentially supplies a scan signal through the scan lines S0 to Sn and sequentially supplies a light-emitting control signal through the light-emitting control lines E1 to En. Here, the scan driver 110 supplies a light-emitting control signal through an i-th light-emitting control line Ei to overlap with a scan signal sequentially supplied through an (i−1)-th scan line Si−1 and an i-th scan line Si.

When a scan signal is supplied, the data driver 120 supplies data signals to the data lines D1 to Dm. Then, the data signals are supplied to the pixels 140 selected by the scan signal.

Figure 2:
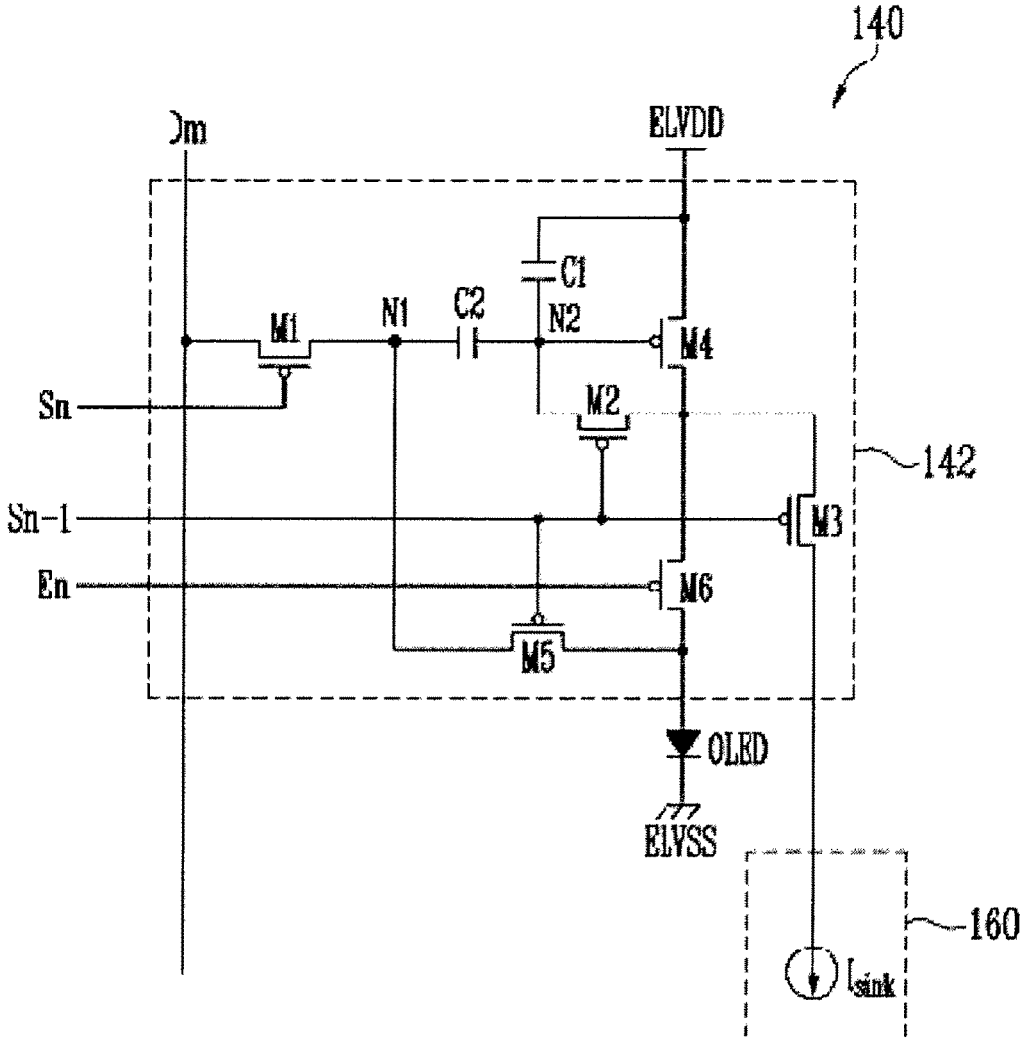
FIG. 2 is a schematic circuit diagram showing an embodiment of a pixel shown in FIG. 1.

The current sinker 160 sinks a predetermined current from the pixels 140 via feedback lines F1 to Fm. Here, the predetermined current is determined as a value at which a desired voltage can be charged into the pixels 140 while allowing the load of each of the feedback lines F1 to Fm to be charged. For example, the predetermined current may be determined to be equal to current that flows into the organic light emitting diodes when the pixels 140 emit light of the highest gray level. As shown in FIG. 2, the current sinker 160 includes a current source Isink. The current source Isink may be used for each channel, or three current sources Isink may be coupled to the feedback lines F1 to Fm coupled to red, green and blue pixels, respectively.

More specifically, different currents flow into red, green and blue pixels 140 corresponding to the maximum luminances of the red, green and blue pixels 140, respectively. Therefore, the current sinker 160 includes three or more current sources Isink having red, green and blue current sources Isink respectively coupled to the red, green and blue pixels 140.

FIG. 2 is a schematic circuit diagram showing an embodiment of a pixel shown in FIG. 1. For the convenience of illustration, a pixel 140 coupled to an m-th data line Dm and an n-th scan line Sn is illustrated in FIG. 2.

Referring to FIG. 2, the pixel 140 according to an embodiment of the present invention includes an organic light emitting diode OLED and a pixel circuit 142 for supplying current to the organic light emitting diode OLED.

The organic light emitting diode OLED emits light having a luminance corresponding to an amount of current supplied from the pixel circuit 142.

The pixel circuit 142 supplies current corresponding to a data signal to the organic light emitting diode OLED. To this end, the pixel circuit 142 includes first to sixth transistors M1 to M6, a first capacitor C1 and a second capacitor C2.

A first electrode of the first transistor M1 is coupled to the data line Dm, and a second electrode of the first transistor M1 is coupled to a first node N1. A gate electrode of the first transistor M1 is coupled to the n-th scan line Sn. When a scan signal (e.g., a low level signal) is supplied to the n-th scan line Sn, the first transistor M1 is turned on to electrically couple the data line Dm to the first node N1. Here, the first electrode is one of drain and source electrodes, and the second electrode is the other electrode. For example, if the first electrode is a source electrode, the second electrode is a drain electrode.

A first electrode of the second transistor M2 is coupled to a second electrode of the fourth transistor M4, and a second electrode of the second transistor M2 is coupled to a second node N2. A gate electrode of the second transistor M2 is coupled to an (n−1)-th scan line Sn−1. When a scan signal (e.g., a low level signal) is supplied to the (n−1)-th scan line Sn−1, the second transistor M2 is turned on to diode-couple the fourth transistor M4.

A second electrode of the third transistor M3 is coupled to the current sinker 160, and a first electrode of the third transistor M3 is coupled to the second electrode of the fourth transistor M4. A gate electrode of the third transistor M3 is coupled to the (n−1)-th scan line Sn−1. When a scan signal is supplied to the (n−1)-th scan line Sn−1, the third transistor M3 is turned on to electrically couple the current source Isink to the second electrode of the fourth transistor M4.

A first electrode of the fourth transistor M4 (or driving transistor) is coupled to a first power source ELVDD, and the second electrode of the fourth transistor M4 is coupled to a first electrode of the sixth transistor M6. A gate electrode of the fourth transistor M4 is coupled to the second node N2. The fourth transistor M4 supplies current to the first electrode of the sixth transistor M6. Here, the current corresponds to a voltage applied to the second node N2, i.e., a voltage charged in the first and second capacitors C1 and C2.

A first electrode of the fifth transistor M5 is coupled to the first node N1, and a second electrode of the fifth transistor M5 is coupled to an anode electrode of the organic light emitting diode OLED. A gate electrode of the fifth transistor M5 is coupled to the (n−1)-th scan line Sn−1. When a scan signal is supplied to the (n−1)-th scan line Sn−1, the fifth transistor M5 is turned on to supply a voltage applied to the anode electrode of the organic light emitting diode OLED to the first node N1.

The first electrode of the sixth transistor M6 is coupled to the second electrode of the fourth transistor M4, and a second electrode of the sixth transistor M6 is coupled to the anode electrode of the organic light emitting diode OLED. A gate electrode of the sixth transistor M6 is coupled to an n-th light-emitting control line En. When a light-emitting control signal (e.g., a high level signal) is supplied to the n-th light-emitting control line En, the sixth transistor M6 is turned off, and when the light-emitting control signal is not supplied to the n-th light-emitting control line En, the sixth transistor M6 is turned on.

Figure 3:
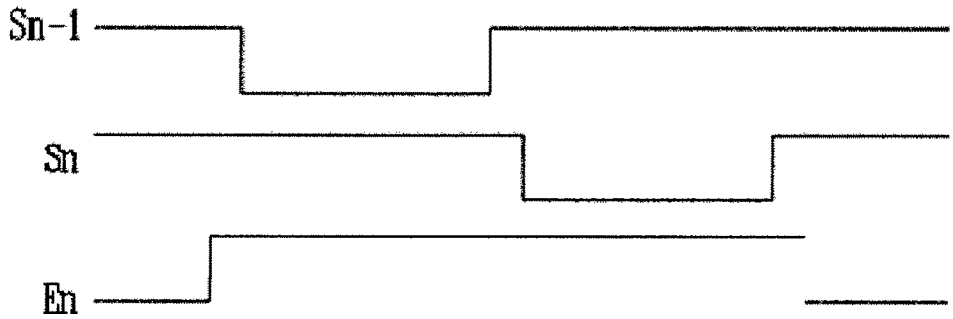
FIG. 3 is a waveform diagram of driving signals supplied from a scan driver shown in FIG. 1.

FIG. 3 is a waveform diagram illustrating a driving method of the pixel shown in FIG. 2.

An operation of the pixel 140 will be described in detail with reference to FIGS. 2 and 3. A light-emitting control signal is first supplied to the light-emitting control line En so that the sixth transistor M6 is turned off.

Thereafter, a scan signal is supplied to the (n−1)-th scan line Sn−1. When the scan signal is supplied to the (n−1)-th scan line Sn−1, the second, third and fifth transistors M2, M3 and M5 are turned on.

When the fifth transistor M5 is turned on, a voltage applied to the anode electrode of the organic light emitting diode OLED is supplied to the first node N1. Here, the voltage applied to the anode electrode of the organic light emitting diode OLED is a threshold voltage of the organic light emitting diode OLED and increases as the organic light emitting diode OLED degrades.

When the third transistor M3 is turned on, the current source Isink is electrically coupled to the second electrode of the fourth transistor M4. When the second transistor M2 is turned on, the fourth transistor M4 is diode-coupled. When the fourth transistor M4 is diode-coupled, the current sunk by the current source Isink flows via the fourth transistor M4. At this time, a voltage corresponding to the current that flows into the fourth transistor M4 is applied to the second node N2.

In this case, a voltage corresponding to a voltage difference between the first and second nodes N1 and N2 is charged in the second capacitor C2. Since the voltage applied to the second node N2 is determined by the current sunk by the current source Isink, a voltage that compensates for the threshold voltage and mobility of the fourth transistor M4 is charged in the second capacitor C2.

Furthermore, a voltage applied to the second node N2 of each of the pixels 140 is determined by the amount of current that flows into the fourth transistor M4 included in each of the pixels 140. Here, the current that flows into the fourth transistor M4 is substantially the same in all the pixels 140. Therefore, the voltage applied to the second node N2 of each of the pixels 140 compensates for the threshold voltage and mobility of the fourth transistor M4.

After a suitable voltage is charged in the second capacitor C2, a scan signal is supplied to the n-th scan line Sn. When the scan signal is supplied to the n-th scan line Sn, the first transistor M1 is turned on. When the first transistor M1 is turned on, a data signal supplied to the data line Dm is supplied to the first node N1.

Therefore, the voltage of the first node N1 rises from the threshold voltage of the organic light emitting diode OLED to the voltage of the data signal. Accordingly, the voltage of the second node N2 also changes corresponding to variation in the voltage of the first node N1. That is, since the second transistor M2 is turned off, the second node N2 is in a floating state. At this time, a voltage charged in a previous period is maintained in the second capacitor C2, and a voltage corresponding to the voltage applied to the first node N1 is charged in the first capacitor C1.

Meanwhile, since the voltage of the first node N1 is changed from the threshold voltage of the organic light emitting diode OLED to the voltage of the data signal, a voltage that compensates for degradation of the organic light emitting diode OLED is charged in the first capacitor C1.

As the organic light emitting diode OLED degrades, the threshold voltage of the organic light emitting diode OLED rises. Therefore, when the same data signal is supplied, increment in the voltage of the first node N1 is decreased as the organic light emitting diode OLED degrades. If the increment in the voltage of the first node N1 is decreased, the voltage applied to the second node N2 is lowered, thereby compensating for the degradation of the organic light emitting diode OLED. In other words, as the organic light emitting diode OLED degrades, the voltage of the second node N2 is lowered, thereby supplying a higher amount of current to the organic light emitting diode OLED corresponding to the same data signal.

As described above, in the present invention, when the scan signal is supplied to the (n−1)-th scan line Sn−1, a voltage that compensates for the threshold voltage and mobility of the fourth transistor M4 is charged in the second capacitor C2. During the period when the scan signal is supplied to the n-th scan line Sn, a voltage that corresponds to a data signal and compensates for the degradation of the organic light emitting diode OLED is charged in the first capacitor C1.

Thereafter, the supply of the light-emitting control signal to the n-th light-emitting control signal is stopped. When the supply of the light-emitting control signal is stopped, the sixth transistor M6 is turned on. When the sixth transistor M6 is turned on, current corresponding to the voltage applied to the second node N2 is supplied to the organic light emitting diode OLED via the sixth transistor M6 from the fourth transistor M4. Then, light having a luminance corresponding to the current supplied from the sixth transistor M6 is emitted from the organic light emitting diode OLED.

Figure 4:
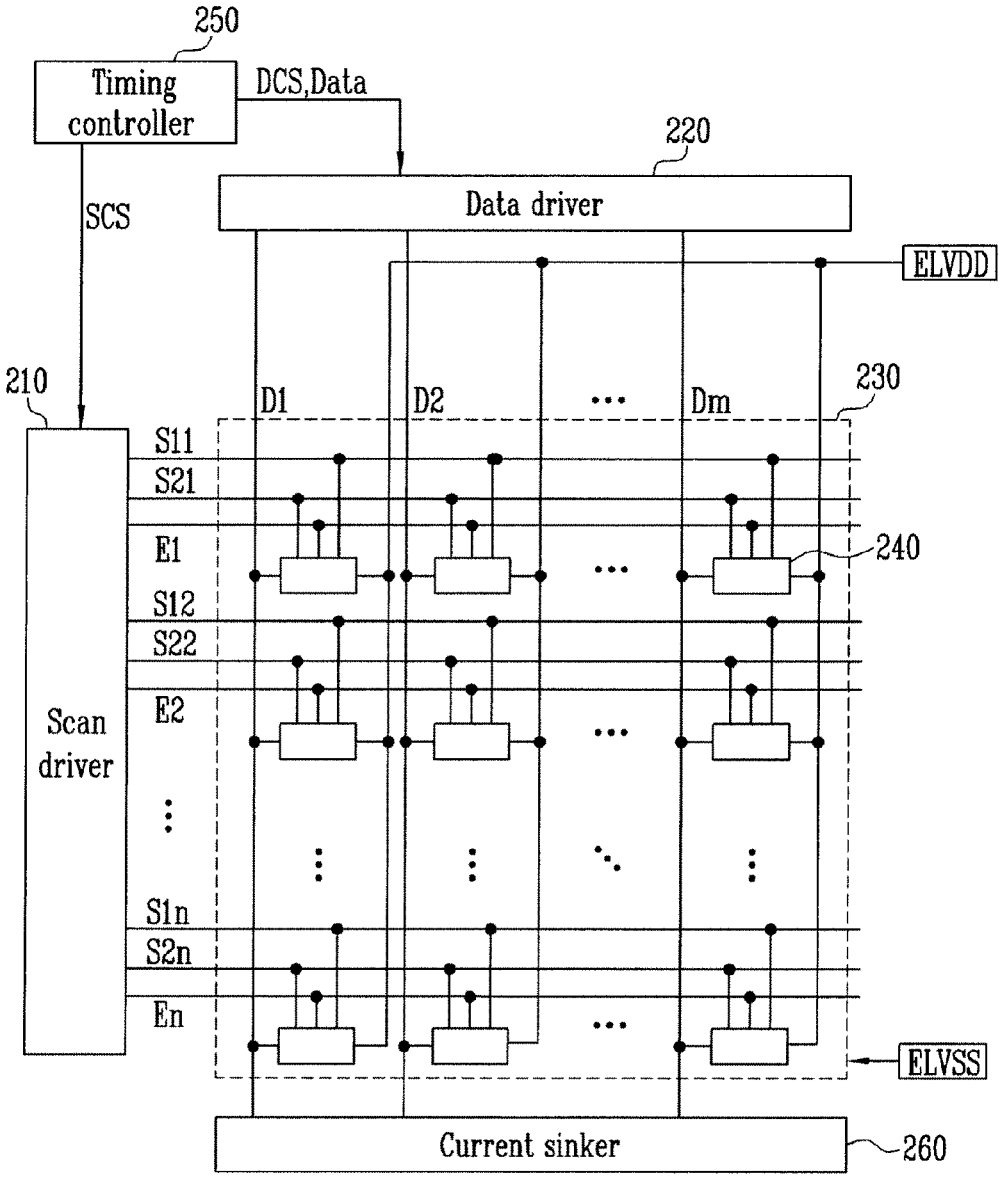
FIG. 4 is a schematic block diagram of an organic light emitting display device according to a second embodiment of the present invention.

FIG. 4 is a schematic block diagram of an organic light emitting display device according to a second embodiment of the present invention.

Referring to FIG. 4, the organic light emitting display device according to the second embodiment of the present invention includes a display unit 230 having a plurality of pixels 240 coupled to first scan lines S11 to S1*n*, second scan lines S21 to S2*n*, light-emitting control lines E1 to En, and data lines D1 to Dm; a scan driver 210 for driving the first scan lines S11 to S1*n*, the second scan lines S21 to S2*n*, and the light-emitting control lines E1 to En; a data driver 220 for driving the data lines D1 to Dm; a timing controller 250 for controlling the scan driver 210 and the data driver 220; and a current sinker 260 for sinking a current (e.g., a predetermined current).

The display unit 230 includes the pixels 240 positioned at crossing regions of the first scan lines S11 to S1*n*, the second scan lines S21 to S2*n*, the light-emitting control lines E1 to En and the data lines D1 to Dm. The pixels 240 receive first power ELVDD and second power ELVSS supplied from the outside of the display unit 230.

Each of the pixels 240 includes an organic light emitting diode. While receiving the first power ELVDD and the second power ELVSS supplied from the outside, the pixel 240 supplies current corresponding to a data signal to the organic light emitting diode. Then, light having a luminance corresponding to the data signal is generated from the organic light emitting diode.

Here, each of the pixels 240 supplies current to the corresponding organic light emitting diode so as to compensate for the threshold voltage and mobility of a driving transistor and the degradation of the organic light emitting diode. Detailed description will be provided later in conjunction with an exemplary structure of the pixels 240.

The timing controller 250 generates a data driving control signal DCS and a scan driving control signal SCS, corresponding to synchronization signals supplied from the outside of the organic light emitting display device. The data driving control signal DCS generated from the timing controller 250 is supplied to the data driver 220, and the scan driving control signal SCS generated from the timing controller 250 is supplied to the scan driver 210. The timing controller 250 also supplies data Data supplied from the outside to the data driver 220.

The scan driver 210 sequentially supplies a first scan signal to the first scan lines S11 to S1*n* and sequentially supplies a second scan signal to second scan lines S21 to S2*n*. Here, the first scan signal supplied to an i-th (i is a natural number) first scan line S1*i* is supplied during a first period in one horizontal period, and the second scan signal supplied to an i-th second scan line S2*i* is supplied during a second period different from the first period in the one horizontal period.

The scan driver 210 sequentially supplies a light-emitting control signal to the light-emitting control lines E1 to En. Here, the light-emitting control signal supplied to an i-th light-emitting control line Ei is supplied to overlap with the first scan signal supplied to the i-th first scan line S1*i* and the second scan signal supplied to the i-th second scan line S2*i*.

The data driver 220 supplies data signals to the data lines D1 to Dm during the second period in the one horizontal period. Then, the data signals are supplied to the pixels 240 selected by the second scan signal.

Figure 5:
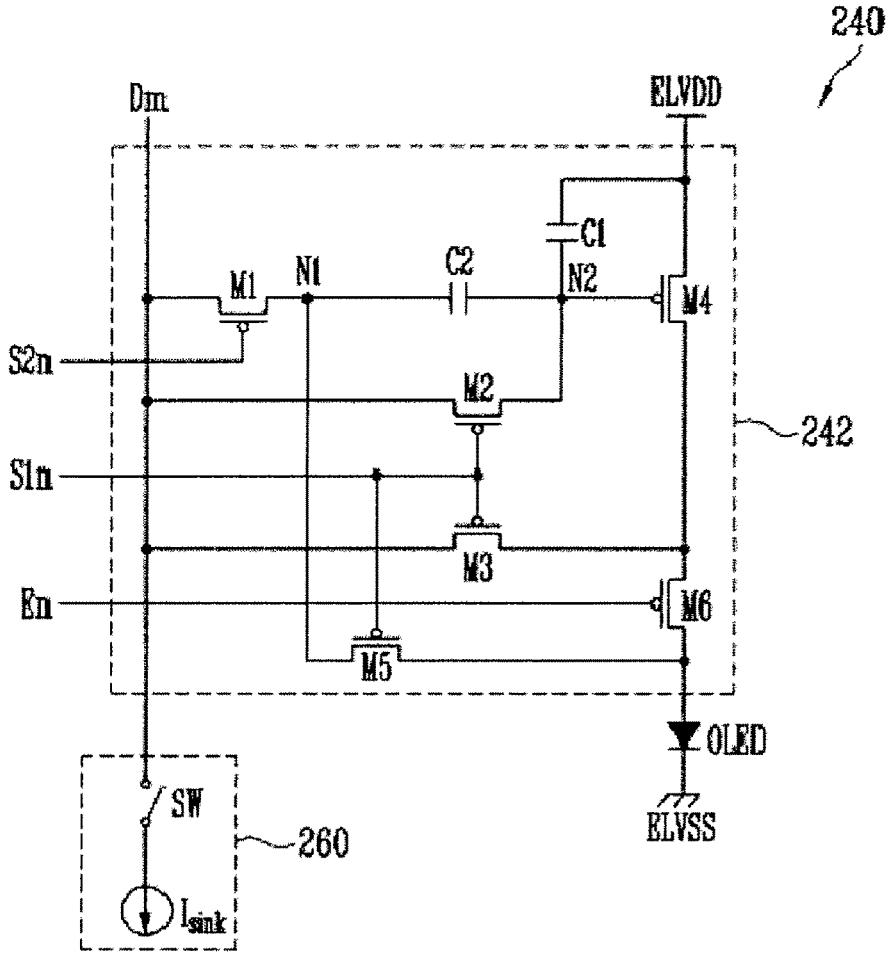
FIG. 5 is a schematic circuit diagram showing an embodiment of a pixel shown in FIG. 4.

The current sinker 260 sinks a current (e.g., a predetermined current) from the pixel 240 selected by the first scan signal during the first period in the one horizontal period. For example, the current has a magnitude that corresponds to the current that flows into the organic light emitting diode when the pixel 240 emits light having the highest gray level. As shown in FIG. 5, the current sinker 260 includes a current source Isink. The current source Isink may be used for each channel, or three current sources Isink may be coupled to feedback lines F1 to Fm coupled to red, green and blue pixels, respectively.

More specifically, different currents flow into red, green and blue pixels 240 corresponding to the maximum luminances of the red, green and blue pixels 240, respectively. Therefore, the current sinker 260 includes three or more current sources Isink having red, green and blue current sources Isink respectively coupled to the red, green and blue pixels 240.

Referring to FIG. 5, a switching element SW is turned on during the first period in the one horizontal period. The current source Isink sinks a current (e.g., a predetermined current) from the pixel 240 when the switching element SW is turned on. Here, the switching element SW may be used for each channel, or one switching element SW may be coupled to all the data lines D1 to Dm. That is, one or more switching elements SW are included in the current sinker 260 and turned on during the first period in the one horizontal period.

FIG. 5 is a circuit diagram showing an embodiment of a pixel shown in FIG. 4. For the convenience of illustration, a pixel 240 coupled to an m-th data line Dm and an n-th light-emitting control line En is illustrated in FIG. 5.

Referring to FIG. 5, the pixel 240 according to an embodiment of the present invention includes an organic light emitting diode OLED and a pixel circuit 242 for supplying current to the organic light emitting diode OLED.

The organic light emitting diode OLED emits light having a luminance corresponding to an amount of current supplied from the pixel circuit 242.

The pixel circuit 242 supplies a current corresponding to a data signal to the organic light emitting diode OLED. To this end, the pixel circuit 242 includes first to sixth transistors M1 to M6, a first capacitor C1 and a second capacitor C2.

A first electrode of the first transistor M1 is coupled to the data line Dm, and a second electrode of the first transistor M1 is coupled to a first node N1. A gate electrode of the first transistor M1 is coupled to a 2n-th scan line S2*n*. When a second scan signal is supplied to the 2n-th scan line S2*n*, the first transistor M1 is turned on to electrically couple the data line Dm to the first node N1.

A first electrode of the second transistor M2 is coupled to the data line Dm, and a second electrode of the second transistor M2 is coupled to a second node N2. A gate electrode of the second transistor M2 is coupled to a 1n-th scan line S1*n*. When a first scan signal is supplied to the 1n-th scan line S1*n*, the second transistor M2 is turned on to electrically couple the data line Dm to the second node N2.

A first electrode of the third transistor M3 is coupled to the data line Dm, and a second electrode of the third transistor M3 is coupled to a second electrode of the fourth transistor M4. A gate electrode of the third transistor M3 is coupled to the 1n-th scan line S1*n*. When a first scan signal is supplied to the 1n-th scan line S1*n*, the third transistor M3 is turned on to electrically couple the data line Dm to the second electrode of the fourth transistor M4.

A first electrode of the fourth transistor M4 (or driving transistor) is coupled to a first power source ELVDD, and the second electrode of the fourth transistor M4 is coupled to a first electrode of the sixth transistor M6. A gate electrode of the fourth transistor M4 is coupled to the second node N2. The fourth transistor M4 supplies current to the first electrode of the sixth transistor M6. Here, the current corresponds to a voltage applied to the second node N2, i.e., a voltage charged in the first and second capacitors C1 and C2.

A first electrode of the fifth transistor M5 is coupled to the first node N1, and a second electrode of the fifth transistor M5 is coupled to an anode electrode of the organic light emitting diode OLED. A gate electrode of the fifth transistor M5 is coupled to the 1n-th scan line S1*n*. When a first scan signal is supplied to the 1n-th scan line S1*n*, the fifth transistor M5 is turned on to supply a voltage applied to the anode electrode of the organic light emitting diode OLED to the first node N1.

The first electrode of the sixth transistor M6 is coupled to the second electrode of the fourth transistor M4, and a second electrode of the sixth transistor M6 is coupled to the anode electrode of the organic light emitting diode OLED. A gate electrode of the sixth transistor M6 is coupled to the n-th light-emitting control line En. When a light-emitting control signal is supplied to the n-th light-emitting control line En, the sixth transistor M6 is turned off, and when the light-emitting control signal is not supplied to the n-th light-emitting control line En, the sixth transistor M6 is turned on.

Figure 6:
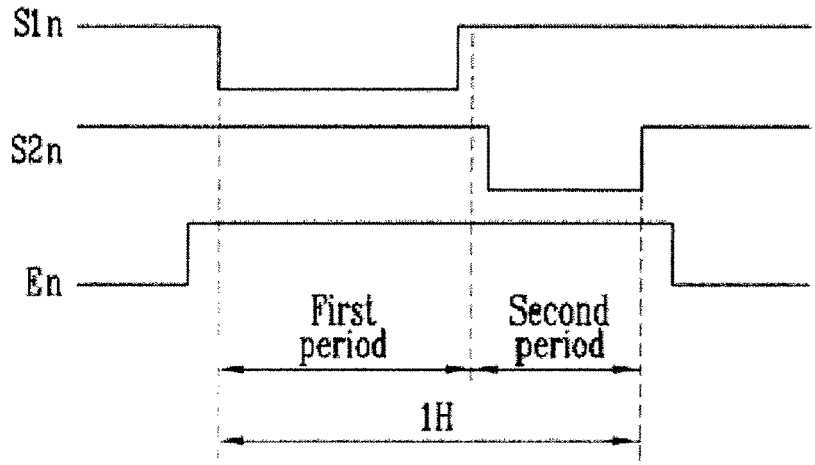
FIG. 6 is a waveform diagram of driving signals supplied from a scan driver shown in FIG. 4.

FIG. 6 is a waveform diagram for illustrating a driving method of the pixel shown in FIG. 5. In FIG. 6, one horizontal period 1H is divided into a first period and a second period. Here, the switching element SW is turned on during the first period.

An operation of the pixel 240 will be described in detail with reference to FIGS. 5 and 6. A light emitting control signal is first supplied to the light-emitting control line En, and the sixth transistor M6 is turned off.

Thereafter, a first scan signal is supplied to the 1n-th scan line S1*n* during the first period of the one horizontal period 1H. When the first scan signal is supplied to the 1n-th scan line S1*n*, the second, third and fifth transistors M2, M3 and M5 are turned on.

When the fifth transistor M5 is turned on, a voltage applied to the anode electrode of the organic light emitting diode OLED is supplied to the first node N1. Here, the voltage applied to the anode electrode of the organic light emitting diode OLED is a threshold voltage of the organic light emitting diode OLED and increases as the organic light emitting diode OLED degrades.

When the second transistor M2 is turned on, the data line Dm is electrically coupled to the second node N2. When the third transistor M3 is turned on, a current (e.g., a predetermined current) is sunk by the current source Isink via the first power source ELVDD, the fourth transistor M4, the third transistor M3 and the switching element SW. When the current is sunk by the current source Isink, a voltage corresponding to the current is applied to the second node N2.

A voltage corresponding to a voltage difference between the first and second nodes N1 and N2 is charged in the second capacitor C2. Since the voltage applied to the second node N2 is determined by the current sunk by the current source Isink, a voltage that compensates for the threshold voltage and mobility of the fourth transistor M4 is charged in the second capacitor C2.

Furthermore, a voltage applied to the second node N2 of each of the pixels 240 is determined by the current that flows into the fourth transistor M4 included in each of the pixels 240. Here, the current that flows into the fourth transistor M4 is substantially the same in all the pixels 240. Therefore, the voltage applied to the second node N2 of each of the pixels 240 is a voltage that compensates for the threshold voltage and mobility of the fourth transistor M4.

After a voltage (e.g., a predetermined voltage) is charged in the second capacitor C2, a second scan signal is supplied to the 2n-th scan line S2*n* during the second period. When the second scan signal is supplied to the 2n-th scan line S2*n*, the first transistor M1 is turned on. When the first transistor M1 is turned on, a data signal supplied to the data line Dm is supplied to the first node N1.

At this time, the voltage of the first node N1 rises from the threshold voltage of the organic light emitting diode OLED to the voltage of the data signal. Accordingly, the voltage of the second node N2 is also changed corresponding to variation in the voltage of the first node N1. That is, since the second transistor M2 is turned off, the second node N2 is in a floating state. At this time, a voltage charged in a previous period is maintained in the second capacitor C2, and a voltage corresponding to the voltage applied to the first node N1 is charged in the first capacitor C1.

Meanwhile, since the voltage of the first node N1 is changed from the threshold voltage of the organic light emitting diode OLED to the voltage of the data signal, a voltage that compensates for degradation of the organic light emitting diode OLED is charged in the first capacitor C1.

Furthermore, as the organic light emitting diode OLED degrades, the threshold voltage of the organic light emitting diode OLED rises. Therefore, when the same data signal is supplied, increment in the voltage of the first node N1 is decreased as the organic light emitting diode OLED degrades. If the increment in the voltage of the first node N1 is decreased, the voltage applied to the second node N2 is lowered, thereby compensating for the degradation of the organic light emitting diode OLED. In other words, as the organic light emitting diode OLED degrades, the voltage of the second node N2 is lowered, thereby supplying a higher current to the organic light emitting diode OLED corresponding to the same data signal.

As described above, in the present invention, a voltage that compensates for the threshold voltage and mobility of the fourth transistor M4 is charged in the second capacitor C2 during the first period of the one horizontal period. During the second period of the one horizontal period, a voltage that corresponds to a data signal and compensates for the degradation of the organic light emitting diode OLED is charged in the first capacitor C1.

Thereafter, the supply of the light-emitting control signal to the n-th light-emitting control signal is stopped. When the supply of the light-emitting control signal is stopped, the sixth transistor M6 is turned on. When the sixth transistor M6 is turned on, current corresponding to the voltage applied to the second node N2 is supplied to the organic light emitting diode OLED via the sixth transistor M6 from the fourth transistor M4. Therefore, light having a luminance corresponding to the current supplied from the transistor M4 is emitted from the organic light emitting diode OLED.

Figure 7:
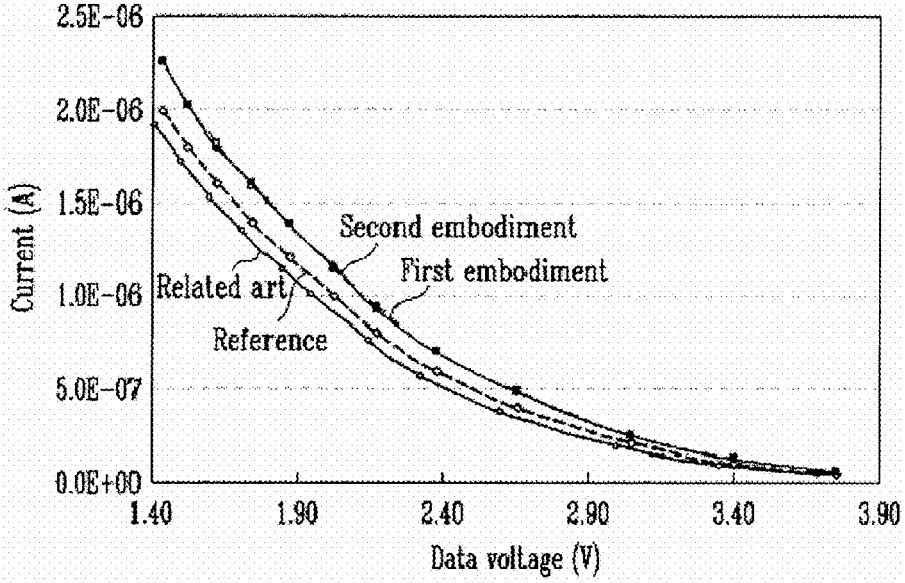
FIG. 7 is a graph showing simulation results of an amount of current that flows in a degraded organic light emitting diode.

FIG. 7 is a graph showing simulation results of an amount of current that flows in a degraded organic light emitting diode. In FIG. 7, the label "reference" refers to the current that flows before the organic light emitting diode is degraded, and the label "related art" shows a result of a pixel (e.g., 5TR 2Cap) generally used to compensate for a threshold voltage.

Referring to FIG. 7, in a related art pixel, an amount of current that flows into an organic light emitting diode is decreased when the organic light emitting diode degrades. Therefore, in the related art pixel, luminance may be lowered corresponding to the degradation of the organic light emitting diode. However, in a pixel according to the first or second embodiment of the present invention, when an organic light emitting diode is degraded, an amount of current for the same data signal is increased, and thus, luminance is maintained at a predetermined level. That is, in the embodiments of the present invention, the degradation of the organic light emitting diode is compensated for, so that an image having a desired luminance can be displayed as the organic light emitting diodes degrade.

Figure 8:
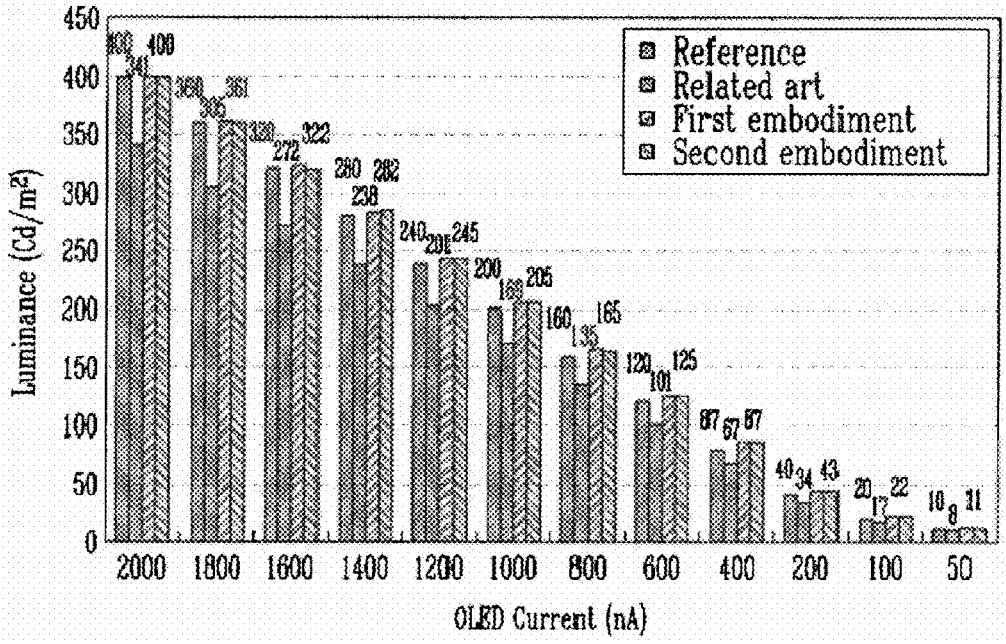
FIG. 8 is a graph showing simulation results of luminance corresponding to degradation of an organic light emitting diode.

FIG. 8 is a graph showing simulation results of luminance corresponding to degradation of an organic light emitting diode.

Referring to FIG. 8, in the related art pixel, luminance is lowered when the organic light emitting diode degrades. However, in the pixel according to the first or second embodiment of the present invention, a predetermined luminance can be maintained even though the organic light emitting diode is degraded.

Figure 9:
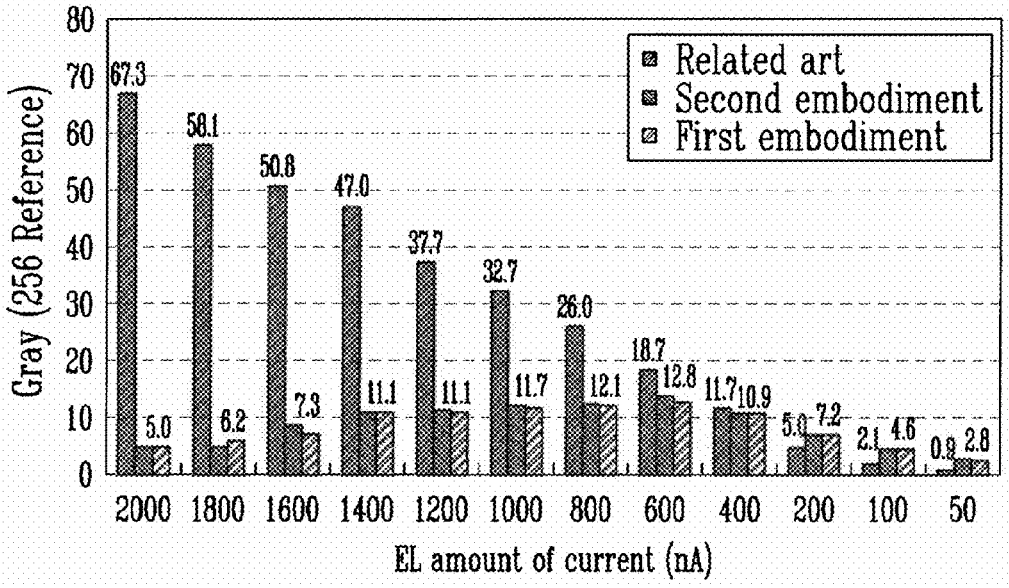
FIG. 9 is a graph showing simulation results for a gray level error corresponding to a change in threshold voltage and mobility of a driving transistor.

FIG. 9 is a graph showing simulation results of a gray level error corresponding to a change in threshold voltage and mobility of a driving transistor. In FIG. 9, the threshold voltage of the driving transistor is changed by ±0.5V, and the mobility of the driving transistor is changed by +10.

Referring to FIG. 9, in the related art pixel, a high gray level error occurs corresponding to a change in threshold voltage and mobility. However, in the embodiments of the present invention, a gray level error is minimized corresponding to a change in threshold voltage and mobility, and accordingly, an image having a desired luminance can be displayed.

While the present invention has been described in connection with certain exemplary embodiments, it is to be understood that the present invention is not limited to the disclosed embodiments, but, on the contrary, is intended to cover various modifications and equivalent arrangements included within the spirit and scope of the appended claims, and equivalents thereof.

What is claimed is:

1. An organic light emitting display device comprising:

a scan driver for supplying a first scan signal to a first scan line during a first period of a horizontal period, supplying a second scan signal to a second scan line during a second period of the horizontal period, and supplying a light-emitting control signal to light-emitting control lines during the horizontal period;

a data driver for supplying data signals to data lines during the second period;

a current sinker coupled to the data lines for sinking a first current; and pixels coupled to the first scan line, the second scan line, the light-emitting control lines and the data lines, wherein each of the pixels on an i-th horizontal line, wherein i is an integer greater than or equal to 1, comprises:

an organic light emitting diode;

a fourth transistor for controlling an amount of current that flows into a second power source via the organic light emitting diode from a first power source;

a first transistor coupled to a gate electrode of the fourth transistor and directly coupled to a data line of the data lines, and configured to turn on when the second scan signal is supplied to the second scan line;

a first capacitor coupled between the gate electrode of the fourth transistor and the first power source;

a second capacitor coupled between the gate electrode of the fourth transistor and the first transistor;

a second transistor directly coupled between the gate electrode of the fourth transistor and the data line, and configured to turn on when the first scan signal is supplied to the first scan line;

a third transistor directly coupled between a second electrode of the fourth transistor and the data line, and configured to turn on when the first scan signal is supplied to the first scan line; and a fifth transistor coupled between an anode electrode of the organic light emitting diode and a common terminal of the first transistor and the second capacitor, and configured to turn on when the first scan signal is supplied to the first scan line.

2. The organic light emitting display device as claimed in claim 1, further comprising a sixth transistor coupled between the fourth transistor and the organic light emitting diode, and configured to turn off when the light-emitting control signal is supplied.

3. The organic light emitting display device as claimed in claim 1, wherein the first current has the same magnitude as the amount of current that flows into the organic light emitting diode when a pixel of the pixels emits light of the highest gray level.

4. The organic light emitting display device as claimed in claim 3, wherein the current sinker comprises at least three current sources comprising a red current source for sinking current from a red pixel of the pixels, a green current source for sinking current from a green pixel of the pixels, and a blue current source for sinking current from a blue pixel of the pixels.

5. The organic light emitting display device as claimed in claim 4, wherein the current sinker comprises at least one switching element coupled between the data line and the current sources and configured to turn on during the first period.

6. A pixel of an organic light emitting display device, the pixel comprising:

an organic light emitting diode;

a pixel circuit for supplying a current to the organic light emitting diode, the pixel circuit comprising:

a fourth transistor for controlling an amount of current that flows into a second power source via the organic light emitting diode from a first power source;

a first transistor coupled to a gate electrode of the fourth transistor and directly coupled to a data line, and configured to turn on when a second scan signal is supplied to a second scan line coupled to a gate electrode of the first transistor;

a first capacitor coupled between the gate electrode of the fourth transistor and the first power source;

a second capacitor coupled between the gate electrode of the fourth transistor and the first transistor;

a second transistor directly coupled between the gate electrode of the fourth transistor and the data line, and configured to turn on when a first scan signal is supplied to a first scan line coupled to the gate electrode of the second transistor;

a third transistor directly coupled between a second electrode of the fourth transistor and the data line, and configured to turn on when the first scan signal is supplied to the first scan line; and a fifth transistor coupled between an anode electrode of the organic light emitting diode and a common terminal of the first transistor and the second capacitor, and configured to turn on when the first scan signal is supplied to the first scan line; and a current sinker coupled to the pixel circuit for sinking a first current.

7. The pixel as claimed in claim 6, wherein the pixel circuit further comprises a sixth transistor coupled between the fourth transistor and the organic light emitting diode, and configured to turn off when a light-emitting control signal is supplied.

8. The pixel as claimed in claim 6, wherein the current sinker comprises at least one switching element coupled between the data line and a current source.

* * * * *

US008284132C1

(12) EX PARTE REEXAMINATION CERTIFICATE (50th)

Ex Parte Reexamination Ordered under 35 U.S.C. 257

United States Patent
Chung

(10) Number: US 8,284,132 C1
(45) Certificate Issued: Mar. 14, 2016

(54) ORGANIC LIGHT EMITTING DISPLAY DEVICE AND METHOD OF DRIVING THE SAME

(75) Inventor: Bo-Yong Chung, Yongin (KR)

(73) Assignee: SAMSUNG DISPLAY CO., LTD., Yongin-Si, Gyeonggi-Do (KR)

Supplemental Examination Request:
No. 96/000,116, Jul. 6, 2015

Reexamination Certificate for:

| | |
|---|---|
| Patent No.: | **8,284,132** |
| Issued: | **Oct. 9, 2012** |
| Appl. No.: | **12/489,280** |
| Filed: | **Jun. 22, 2009** |

(30) Foreign Application Priority Data

Jul. 17, 2009 (KR) ..... 10-2008-0069529

(51) Int. Cl.

| | |
|---|---|
| ***G09G 3/30*** | (2006.01) |
| ***G09G 3/10*** | (2006.01) |
| ***G09G 3/32*** | (2006.01) |

(52) U.S. Cl.
CPC ..... *G09G 3/3233* (2013.01); *G09G 3/3275* (2013.01); *G09G 2300/0819* (2013.01); *G09G 2300/0852* (2013.01); *G09G 2300/0861* (2013.01); *G09G 2310/0251* (2013.01); *G09G 2310/0262* (2013.01)

(58) Field of Classification Search
CPC ..... G09G 3/3233; G09G 3/2022; G09G 3/22; G09G 3/29; G09G 3/30; G09G 3/346; G09G 3/2014; G09G 3/2018; G09G 3/2927; G09G 2320/043; G09G 2320/2069; G09G 2300/0842; G09G 2300/043; G09G 2300/0452; G09G 3/32
USPC ..... 345/76–84
See application file for complete search history.

(56) References Cited

To view the complete listing of prior art documents cited during the supplemental examination proceeding and the resulting reexamination proceeding for Control Number 96/000,116, please refer to the USPTO's public Patent Application Information Retrieval (PAIR) system under the Display References tab.

*Primary Examiner* — Henry Tran

(57) ABSTRACT

An organic light emitting display device and a method of driving the same. In a method of driving an organic light emitting display device including a second capacitor having a first terminal coupled to a gate electrode of a driving transistor and a first capacitor coupled between the gate electrode of the driving transistor and a first power source, the driving method includes supplying a threshold voltage of an organic light emitting diode to a second terminal of the second capacitor during a period when a first current is sunk via the driving transistor, and supplying a data signal to the second terminal of the second capacitor after a voltage corresponding to a difference between a voltage applied to the gate electrode of the driving transistor and the threshold voltage of the organic light emitting diode is charged in the second capacitor.

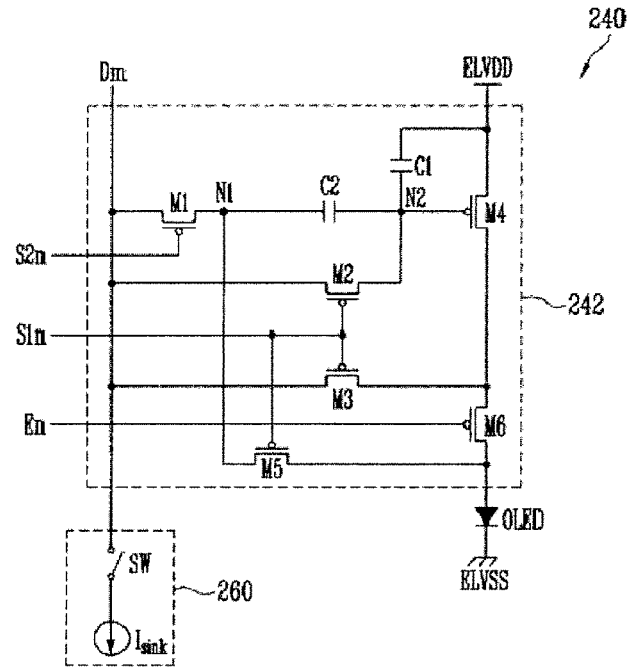

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 6 are determined to be patentable as amended.

Claims 2-5, 7 and 8, dependent on an amended claim, are determined to be patentable.

1. An organic light emitting display device comprising:

a scan driver for supplying a first scan signal to a first scan line during a first period of a horizontal period, supplying a second scan signal to a second scan line during a second period of the horizontal period, and supplying a light-emitting control signal to light-emitting control lines during the horizontal period;

a data driver for supplying data signals to data lines during the second period;

a current sinker coupled to the data lines for sinking a first current; and pixels coupled to the first scan line, the second scan line, the light-emitting control lines and the data lines, wherein each of the pixels on an i-th horizontal line, wherein i is an integer greater than or equal to 1, comprises:

an organic light emitting diode;

a fourth transistor for controlling an amount of current that flows into a second power source via the organic light emitting diode from a first power source;

a first transistor coupled between a gate electrode of the fourth transistor and directly coupled to a data line of the data lines, and configured to turn on when the second scan signal is supplied to the second scan line;

a first capacitor coupled between the gate electrode of the fourth transistor and the first power source;

a second capacitor coupled between the gate electrode of the fourth transistor and the first transistor;

a second transistor directly coupled between the gate electrode of the fourth transistor and the data line, and configured to turn on when the first scan signal is supplied to the first scan line;

a third transistor directly coupled between a second electrode of the fourth transistor and the data line, and configured to turn on when the first scan signal is supplied to the first scan line; and a fifth transistor *having a first electrode coupled to a common terminal of the first transistor and the second capacitor, a second electrode coupled to an anode electrode of the organic light emitting diode, and a gate electrode coupled to the first scan line, whereby the fifth transistor is* coupled between [an] *the* anode electrode of the organic light emitting diode and [a] *the* common terminal of the first transistor and the second capacitor, [and] *the fifth transistor being* configured to turn on when the first scan signal is supplied to the first scan line.

6. A pixel of an organic light emitting display device, the pixel comprising:

an organic light emitting diode;

a pixel circuit for supplying a current to the organic light emitting diode, the pixel circuit comprising:

a fourth transistor for controlling an amount of current that flows into a second power source via the organic light emitting diode from a first power source;

a first transistor coupled to a gate electrode of the fourth transistor and directly coupled to a data line, and configured to turn on when a second scan signal is supplied to a second scan line coupled to a gate electrode of the first transistor;

a first capacitor coupled between the gate electrode of the fourth transistor and the first power source;

a second capacitor coupled between the gate electrode of the fourth transistor and the first transistor;

a second transistor directly coupled between the gate electrode of the fourth transistor and the data line, and configured to turn on when a first scan signal is supplied to a first scan line coupled to the gate electrode of the second transistor;

a third transistor directly coupled between a second electrode of the fourth transistor and the data line, and configured to turn on when the first scan signal is supplied to the first scan line; and a fifth transistor *having a first electrode coupled to a common terminal of the first transistor and the second capacitor, a second electrode coupled to an anode electrode of the organic light emitting diode, and a gate electrode coupled to the first scan line, whereby the fifth transistor is* coupled between [an] *the* anode electrode of the organic light emitting diode and [a] *the* common terminal of the first transistor and the second capacitor, [and] *the fifth transistor being* configured to turn on when the first scan signal is supplied to the first scan line; and a current sinker coupled to the pixel circuit for sinking a first current.

* * * * *